US007234659B2

(12) United States Patent
Torihara et al.

(10) Patent No.: US 7,234,659 B2
(45) Date of Patent: Jun. 26, 2007

(54) PULVERIZER

(75) Inventors: Tetsurou Torihara, Osaka (JP); Naoto Iwamoto, Osaka (JP)

(73) Assignee: Okada Aiyon, Osaka (JP)

( * ) Notice: Subject to any disclaimer, the term of this patent is extended or adjusted under 35 U.S.C. 154(b) by 0 days.

(21) Appl. No.: 10/470,899

(22) PCT Filed: Feb. 7, 2001

(86) PCT No.: PCT/JP01/00860

§ 371 (c)(1),
(2), (4) Date: Nov. 21, 2003

(87) PCT Pub. No.: WO02/063118

PCT Pub. Date: Aug. 15, 2002

(65) Prior Publication Data

US 2005/0035235 A1 Feb. 17, 2005

(51) Int. Cl.
*E02F 9/22* (2006.01)
*E04G 23/08* (2006.01)

(52) U.S. Cl. ..... 241/266; 241/101.71; 241/101.72; 241/101.73; 30/134

(58) Field of Classification Search ..... 241/101.73, 241/266, 101.72, 101.71; 30/134
See application file for complete search history.

(56) References Cited

U.S. PATENT DOCUMENTS 4,235,155 A * 11/1980 Shafer ..... 91/361
5,375,329 A * 12/1994 Morikawa et al. ..... 30/134

FOREIGN PATENT DOCUMENTS

| | | |
|---|---|---|
| JP | 62 083504 | 4/1987 |
| JP | 02 232470 | 9/1990 |
| JP | 2000 027239 | 1/2000 |
| JP | 2000-027239 | * 1/2000 |
| JP | 2001-027239 | 1/2000 |
| JP | 2000-309951 | * 11/2000 |
| JP | 2001-065608 | 3/2001 |

* cited by examiner

*Primary Examiner*—Derris H. Banks
*Assistant Examiner*—Jason Y. Pahng
(74) *Attorney, Agent, or Firm*—Wood, Phillips, Katz, Clark & Mortimer

(57) ABSTRACT

An automatically swiveling crushing apparatus has a swiveling motor in a bracket, and branches diverged from charging and discharging paths that constitute the hydraulic piping leading to a cylinder for closing or opening distal crushing arms. One of the branches extends from one of the paths then operating to open the end arms, so that a portion of the hydraulic fluid is fed to the hydraulic motor if and when internal pressure in this branch has exceeded an upper limit. The other branch extends from the other path leading to the cylinder so as to close the end arms, and this branch prevents any amount of hydraulic fluid from flowing back to the motor. The branches render dispensable a discrete or independent hydraulic piping in a self-propelled platform having a proximal working arm to be connected to the apparatus, saving cost and labor in connecting this arm to the apparatus.

14 Claims, 10 Drawing Sheets

PULVERIZER

FIELD OF THE INVENTION

The present invention relates to an attachment for use in combination with a construction machinery that is mounted on a self-propelled working platform or truck, and more particularly relates to a crushing apparatus to be mounted thereon.

BACKGROUND OF THE INVENTION

Self-propelled working platforms or trucks such as a hydraulic shovel do generally have attachments connected to the ends of working arms of said platforms. An example of these attachments is a crushing apparatus, which will typically comprise a pair of end arms. Each of the end arms may be shaped as an array of fingers or crab's nails, and a hydraulic cylinder will operate to close or open the end arms.

When a building is demolished using such a crushing apparatus, an operator will have to control its position, posture and/or angular direction in which the pair of end arms are closed or opened, suitably for target article. In order to enable such an operation, those end arms need to swivel as a whole.

For the purpose of turning or swiveling each pair of end arms on the crushing apparatus, they may either be forced to swivel against a braking member to which they are pressed, or be driven automatically by an actuator such as an hydraulic cylinder.

In the former case of forcible swiveling, a crushing apparatus as disclosed in the Japanese Patent Publication No. 7-103700 may for example be used.

A body frame of the crushing apparatus shown in this publication '700 is connected by a swivel bearing to the arm of a power shovel or the like. A disc brake is employed in this case to impart a frictional resistance to the body frame of such crushing apparatus.

Crushing apparatuses of this type are simple in structure, and also advantageous in that any excessively strong torsion acting on each crushing apparatus during its demolishing operation would automatically cause it to rotate in such a manner as protecting it from breakage.

However, it is a disadvantage of this type crushing apparatuses that only those who are highly skilled are allowed to operate them.

Further, a fastening torque for the disc brakes incorporated in such prior art apparatuses is difficult to adjust easily and adequately. Any unintentional rotation resulting from contact with any obstacle or any offset in gravitational center of the crushing apparatus may advantageously be avoided, by selecting a stronger fastening torque for the disc brake. If the torque applied to the disc brake is too intensive, then an excessively strong impact will be needed to swivel the apparatus, thereby incurring an undesirable shock on it and causing its serious damage. A lower fastening torque may be adopted to resolve this problem. However, there will arise another problem that even any weak impact acting on the pair of end arms would be enough to unintentionally rotate them to a wrong angular position, thus lowering efficiency of breaking operations. A friction plate in each disc brake is likely to become worn out soon, impairing its braking effect. The friction plate should be replaced frequently with a new one, so that maintenance works including the adjusting of fastening torque have to be repeated many times.

A proper braking force will be maintained, only if such intricate adjusting and maintenance works are done by well-experienced and highly-skilled operators at considerably short intervals of time.

In the latter case of automatic swiveling, a hydraulic motor or the like has to be installed in the crushing apparatus so that a body frame thereof is operatively connected to said motor.

Discrete hydraulic fluid lines are necessary along the working arm of a hydraulic power shovel, respectively for the hydraulic cylinder for closing and opening the end arms and for the hydraulic motor for swiveling these arms. Distal ends of the two hydraulic fluid lines are adjoined to a hydraulic connector disposed on a bracket of the crushing apparatus, so that an operator within a cabin will use a pedal and/or lever to close or open the end arms and also to swivel same. Thus, the operator can do his work for swiveling the arms more easily by virtue of such a hydraulic system, although a complicated piping and a lot of hydraulic devices are indispensable.

It does not suffice to equip the hydraulic shovel with an oil piping for closing or opening the pair of end arms as the principal parts of a crushing apparatus attached to said shovel. Another piping independent of the said one piping and comprising a control valve, a maneuverable pedal and/or lever should be mounted on the prior art crushing apparatus in order to actuate the hydraulic motor for swiveling the pair of end arms. Thus, two independent oil lines necessary for the closing/opening and swiveling of the pair of end arms will raise material and labor costs in transforming the power shovel. In a case wherein an additional casing drain must be returned to a central reservoir for certain types of hydraulic motors, the material and labor costs will rise further.

DISCLOSURE OF THE INVENTION

The present invention was made to resolve the problems inherent in the prior art crushing apparatuses of the automatic swiveling type. An object of the present invention is therefore to provide a crushing apparatus designed such that a hydraulic circuit for automatically running a hydraulic motor for automatically swiveling a pair of end arms is branched off from a main piping leading to a hydraulic cylinder for closing/opening the pair of end arms. Another object of the invention is to dispense with an additional independent piping for swiveling the arms so as to reduce a transforming cost of the power shovel and to enable quick mounting and dismounting of the crushing apparatus on and off the power shovel.

Still another object of the invention is to smoothly relieve any impactive torsion that would occasionally be imparted to a working crushing apparatus, thus protecting it from breakage.

Yet another object is to provide such an innovated braking mechanism that can apply to a forcible swiveling system in which the end arms are pressed to a braking member. In this mechanism, any mechanical friction such as produced by a disc brake will not be needed, thereby improving durability and reliability of the system, simplifying the maintenance and adjusting works therefor and elongating the time intervals at which these works are to be done.

In order to achieve these objects, a crushing apparatus provided herein does comprise, in addition to a hydraulic cylinder for closing/opening a pair of arms, a hydraulic motor mounted on the apparatus to swivel the arms and branches diverging from a hydraulic piping leading to the cylinder, such that the branch is operatively connected to the motor. In operation for crushing work, the hydraulic fluid will be fed to the cylinder at a full rate. When the arms at their full opened position are to be swiveled, an excessive amount of the hydraulic fluid will be delivered additionally to said cylinder such that a rise in pressure thus produced will cause a part of the excessive amount to be applied to the motor so as to rotate the arms.

In such a crushing apparatus of the invention, the swiveling motor may be disposed in a bracket or the like, and the branches diverge respectively from a pair of charging and discharging paths that constitute the hydraulic piping leading to the cylinder. Basically, one of the branches originates from the charging path leading to an inlet side of the cylinder then operating to open the arms, and the one branch is constructed to forward a portion of the hydraulic fluid to the hydraulic motor if and when an internal pressure in this branch will exceed an upper limit. The other branch originates from the discharging path leading to another inlet side of the cylinder then operating to close the arms, and this branch is constructed to prevent any amount of hydraulic fluid from flowing back towards the motor.

Preferably in the crushing apparatus just summarized above, a relieving throttle valve may be disposed in the one branch originating from the charging path leading to the inlet side of the cylinder then operating to open the arms. A check valve may be disposed in the other branch originating from the other charging path (viz., the discharging path referred to above) leading to the another inlet side of the cylinder then operating to close the arms.

A means for bypassing and buffering any impacting internal pressure may be installed in the branches, and preferably intermediate between the throttle valve and the hydraulic motor or intermediate between the check valve and this motor.

Preferably, the bypassing and buffering means may comprise two parallel bypass lines that are connected each to both the branches and have regulating relief valves respectively disposed therein, with one of them facing counter the other. In an alternative example, check valves may be disposed in the branches, also one of them facing counter the other, so that middle portions between these check valves do communicate with each other through a regulating relief valve.

Alternatively, a pilot switching valve and a resistance device may be used in combination to form such a bypassing and buffering means, wherein this valve senses the fluid pressure at two ports of the hydraulic motor so that the resistance device is caused to communicate with one of the ports where the pressure has risen.

Also alternatively, a one-way resisting device may be disposed in each bypass line such that the hydraulic fluid can freely flow in one direction through the bypass line, but cannot do so in the other direction unless the pressure exceeds a threshold. In a further alternative mode of the bypassing and buffering means, a pilot switching valve may be employed in combination with a relief valve and a check valve that are arranged such that the check valve will open when the fluid pressure is to be relieved. In this case, the pilot switching valve will operate to automatically bring the inlet side of relief valve into communication with one of the hydraulic motor's ports whose pressure has risen.

In addition to the elements mentioned above with respect to the hydraulic circuit, a delay device may be built in one of the branches and downstreamly of the relieving throttle valve so that this branch is opened when a predetermined period of time has lapsed after an amount of hydraulic fluid was urged towards said branch. In this case, delivery of the amount of fluid to the hydraulic motor for swiveling the arms will be delayed a noticeable time after the arms have opened fully.

The delay device may preferably be composed of a switch-over valve having two alternative positions for inhibiting or permitting the flow of hydraulic fluid, a communication path for bringing an inlet port of this valve into a fluid communication with a pilot chamber, and a return path for causing the pilot chamber to communicate with an upstream side of the relieving throttle valve, passing though the check valve. The switch-over valve has a spool installed therein, and this spool has one end in contact with a coiled spring and another end in contact with a biasing means comprising the pilot chamber noted above. The coiled spring will normally urge the spool towards one of the alternative positions where the hydraulic fluid is inhibited to flow. If and when an excessive amount of hydraulic fluid has been forced into the pilot chamber, the spool will be driven to its another position where the hydraulic fluid is allowed to flow.

In particular, the present invention is directed to a crushing apparatus that is attachable to a working arm of a self-propelled platform or truck, and that comprises crushing arms capable of being closed or opened by a hydraulic actuator as well as a swiveling mechanism having a hydraulic motor for driving the crushing arms to swivel. This apparatus further comprises a branch diverged from a hydraulic fluid path communicating with the actuator for closing and opening the crushing arms, with this path feeding the hydraulic fluid to said actuator when the crushing arms are driven to open. Disposed in the branch is an on-off means that normally keeps the branch closed, but will open this branch so as to drive the motor only when a pressure applied to the actuator rises above a predetermined level while the crushing arms remain opened.

Similarly, the present invention is directed to a crushing apparatus that is attachable to a working arm of a self-propelled platform or truck, and that comprises crushing arms capable of being closed or opened by a hydraulic actuator as well as a swiveling mechanism having a hydraulic motor for driving the crushing arms to swivel. This apparatus further comprises, in addition to hydraulic fluid paths respectively continuing to or from the actuator, branches diverged from the respective paths so as to communicate with the motor for swiveling the crushing arms. One of these paths will feed the hydraulic fluid to said actuator then the crushing arms are driven to open. Disposed in one of the branches that is diverged from a hydraulic fluid path for feeding the hydraulic fluid to the actuator when the crushing arms are driven to open is an on-off means that normally keeps this branch closed, but will open it so as to drive the motor only when a pressure applied to the on-off means rises above a predetermined level. A backflow inhibitor is disposed in the other branch so that any amount of the hydraulic fluid cannot flow back towards the hydraulic motor.

A portion of the hydraulic fluid that is flowing to and through the arm closing/opening actuator so as to open the crushing arms to be kept open will thus be fed to the arm swiveling motor. In other words, this motor will never be actuated while the arms remain closed to crush a concrete block or the like.

The on-off means normally continues to keep closed the branch diverged from the main path for the hydraulic fluid flow for closing or opening the arms, unless the pressure applied to the actuator rises above the predetermined level.

By virtue of this feature, the motor for swiveling these arms will not tend to operate when they are just being opened during any normal work.

It will now be apparent that the crushing arms of the present crushing apparatus must be opened at first and be kept open for a while, before they will be swiveled subsequently. The hydraulic fluid will never be applied to the swiveling motor, until the pressure inside the upstream region of the branch rises above the predetermined level to switch on the on-off means so as to open the branch.

The on-off means may be composed of a relief valve and a throttle valve.

This relief valve may preferably be capable of adjusting and regulating its operative pressure.

Preferably, a means for bypassing and buffering any impacting internal pressure may be employed for the arm-swiveling hydraulic motor.

For this purpose, two ports may be formed in the swiveling motor in order to charge it with the hydraulic fluid and also to discharge the fluid from the motor. One, two or more bypass lines normally standing closed may be formed between the two ports, so that when one of the ports shows a pressure above a predetermined value, this port will come into fluid communication with the other port of a lower pressure.

As an alternative to this example, two ports are likewise formed in the swiveling motor as an inlet and an outlet for the hydraulic fluid. However in this case, each of two bypass lines respectively intervening between the two ports have relief valves that are installed in the respective lines but in opposite directions. A check valve may be disposed beside and in parallel with each relief valve so as to constitute a sub-bypass in each bypass line.

In another alternative wherein two ports are formed in the swiveling motor as an inlet and an outlet for the hydraulic fluid, two bypass lines 'A' and 'B' intervene between these ports. A couple of first check valves disposed in one of the bypass lines 'A' may be arranged face-to-face, with a couple of second check valves being arranged back-to-back in the other bypass line 'B'. A relief valve is employed to connect a first intermediate point between the first check valves to a second intermediate point between the second check valves, so that an amount of hydraulic fluid will be permitted to flow from the bypass line 'A' to the other one 'B' when a pressure at the first intermediate point rises above a limit.

Preferably, a delay device may be incorporated in the branch such that when a pressure therein or in the main hydraulic path has exceeded a limit and a given period of delay time has lapsed, an amount of hydraulic fluid will be supplied to the swiveling motor.

The on-off means in connection with the delay device is composed of a relief valve and a throttle valve, and the delay device itself may preferably be composed of a switch-over pilot valve, a communication path and a return path. The pilot valve has two alternative positions for inhibiting or permitting the flow of hydraulic fluid, and the communication path for bringing an inlet port of this valve into a fluid communication with a pilot chamber. The return path causes the pilot chamber to communicate with an upstream side of the relieving throttle valve, passing though the check valve. The switch-over valve has a spool that remains urged towards one of the alternative positions where the hydraulic fluid is inhibited to flow. If and when an excessive amount of hydraulic fluid has been forced into the pilot chamber, the spool will be driven to its another position where the hydraulic fluid is allowed to flow.

The delay device may alternatively be an additional hydraulic cylinder connected in parallel to the swiveling hydraulic motor.

It is necessary for the additional cylinder to be actuated at a pressure lower than that at which the swiveling motor is actuated.

From a viewpoint of safety afforded by bypassing any impacting pressure, the invention provides a crushing apparatus that is attached to a working arm of a self-propelled platform or truck, and that comprises a fixed race, a movable race cooperating therewith to form a freely swiveling mechanism, a swiveling hydraulic motor, two ports formed in the swiveling hydraulic motor as an inlet and an outlet, both for the hydraulic fluid, and at least one bypass line intervening between these ports. The apparatus further comprises a bearing race-side gear and a motor-side gear engaging therewith such that the former gear operates in unison with the movable race, with the latter gear rotating in unison with the motor, wherein the at least one bypass line normally standing closed is to be opened when one of the ports shows a pressure above a predetermined value, so that the one port will come into fluid communication with the other port of a lower pressure.

As an alternative to this example, two ports are likewise formed in the swiveling motor as an inlet and an outlet for the hydraulic fluid. However in this case, two bypass lines intervening between the two ports have relief valves that are installed in the respective lines but in opposite directions. A check valve may be disposed beside and in parallel with each relief valve so as to constitute a sub-bypass in each bypass line.

In another alternative wherein two ports are formed in the swiveling motor as an inlet and an outlet for the hydraulic fluid, two bypass lines 'A' and 'B' intervene between these ports. A couple of first check valves disposed in one of the bypass lines 'A' may be arranged face-to-face, with a couple of second check valves being arranged back-to-back in the other bypass line 'B'. A relief valve is employed to connect a first intermediate point between the first check valves to a second intermediate point between the second check valves, so that an amount of hydraulic fluid will be permitted to flow from the bypass line 'A' to the other one 'B' when a pressure at the first intermediate point rises above a limit.

A pilot switching valve may be incorporated in the at least one bypass line in combination with a resistance device. In this case, the valve will sense the fluid pressure at two ports of the hydraulic motor so that the resistance device is caused to communicate with one of the ports where the pressure has risen.

Also preferably, a one-way resisting device may be disposed in each bypass line such that the hydraulic fluid can freely flow in one direction through the bypass line, but cannot do so in the other direction unless the pressure exceeds a threshold. Both the one-way resisting devices will allow portions of the hydraulic fluid to flow towards the motor, but inhibit these portions from flowing in counter directions.

Alternatively, a pilot switching valve may be employed in combination with a relief valve and a check valve that are arranged such that the check valve will open when the fluid pressure is to be relieved. In this case, the pilot switching valve responsive to pressure at each of the ports will operate to automatically bring the inlet side of relief valve into communication with one of the hydraulic motor's ports whose pressure has risen.

Preferably, a compensation means may be disposed in either or each bypass line. This means will operate to maintain the amount of hydraulic fluid in the bypass line neither too much nor too less.

A hydraulic fluid reservoir may be used as the compensation means.

It is preferable to employ a compressing means to compress always the hydraulic fluid stagnant in the reservoir.

Such a compensation means may be arranged either in series to or in parallel with the bypass line.

From a still further point of view, the present invention provides an attachment for use in a construction machinery, and this attachment may be adapted for connection to a working arm mounted on a self-propelled working platform or truck that has a hydraulic-pressure-generating equipment. The attachment comprises a swiveling mechanism such that a hydraulic swiveling actuator will rotate the attachment. The attachment further comprises a branch that diverges from a main path connected to another hydraulic actuator so that the swiveling actuator receives a flow of hydraulic fluid through the branch. The attachment further comprises an on-off means, disposed in the branch, that will open this branch so as to drive the swiveling actuator only when a pressure in the main path rises above a predetermined level.

An example of such an attachment may be a crushing apparatus having crushing arms, wherein the another actuator is a hydraulic cylinder that closes and opens the arms.

The branch preferably may diverge from a portion of the main path feeding the hydraulic fluid to open the crushing arms.

An example of the swiveling actuator may be a hydraulic motor.

From a yet still further point of view, the present invention provides an attachment for use in a construction machinery, and this attachment may be adapted for connection to a working arm mounted on a self-propelled working platform or truck. The attachment comprises a hydraulic motor as well as a swiveling mechanism in an operative connection therewith. The attachment further comprises at least one bypass line normally standing closed and connected to two ports, one functioning as an inlet and the other as an outlet of the hydraulic fluid fed to the motor. The bypass line will open when one of the ports shows a pressure above a predetermined value, so that the one port will come into fluid communication with the other port of a lower pressure.

BEST MODES OF CARRYING OUT THE INVENTION

An auto-swiveling crushing apparatus of the invention must comprise at least one hydraulic motor 5. This motor 5 operates to drive the crushing apparatus to swivel in the first to fourth embodiments, whilst it operates to brake the crushing apparatus swiveling in the fifth to seventh embodiments.

Figure 8:
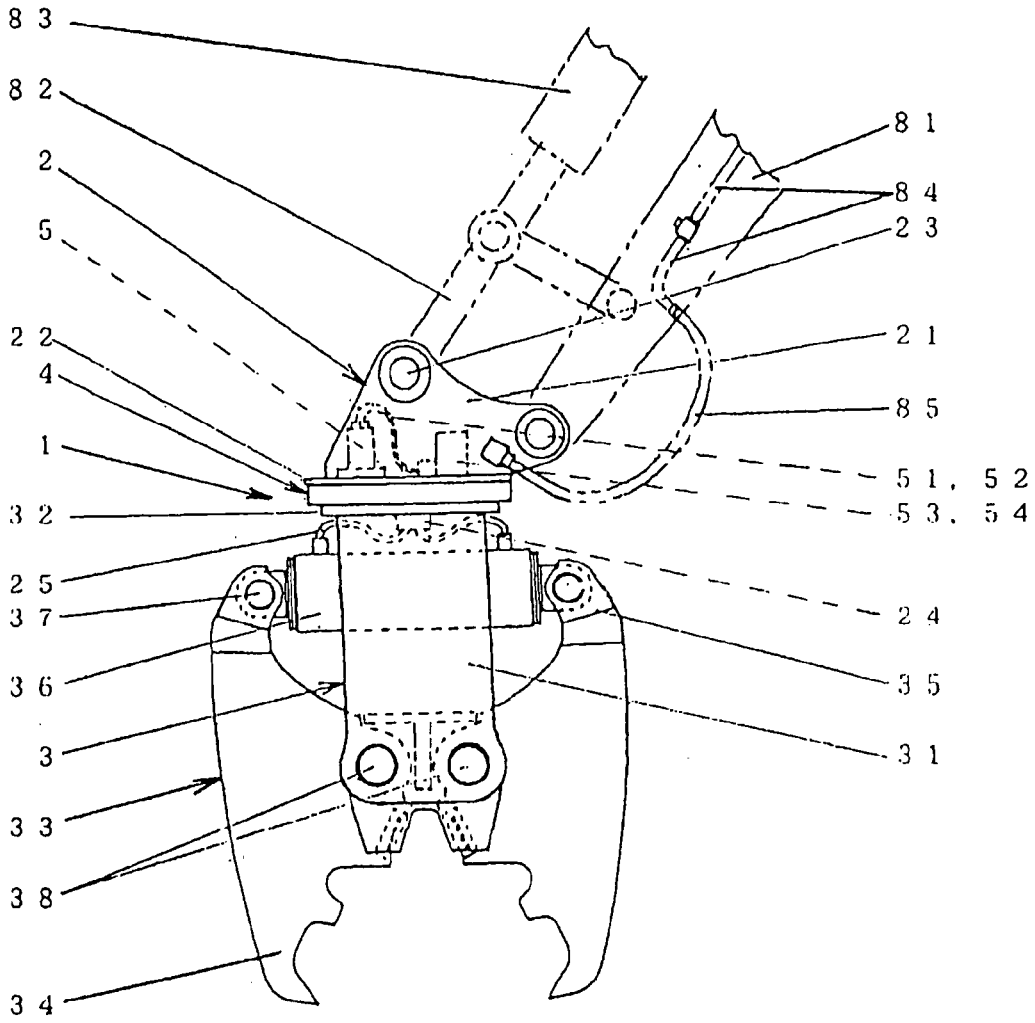
FIG. 8 is a front elevation of the crushing apparatus provided herein.

There are two types of crushing apparatuses, and one of them is the double-acting type shown in FIG. 8. In this case, a frame is rotatably connected by a swiveling bearing to a bracket, so that a pair of swingable crushing arms are pivoted to the frame. Although a single-acting type of the crushing apparatus is not shown, its frame is likewise rotatably connected by a swiveling bearing to a bracket. However, its fixed arm protrudes forwards from the frame and a swiveling arm is pivoted to a basal portion of the frame so as to face the fixed arm.

Figure 1:
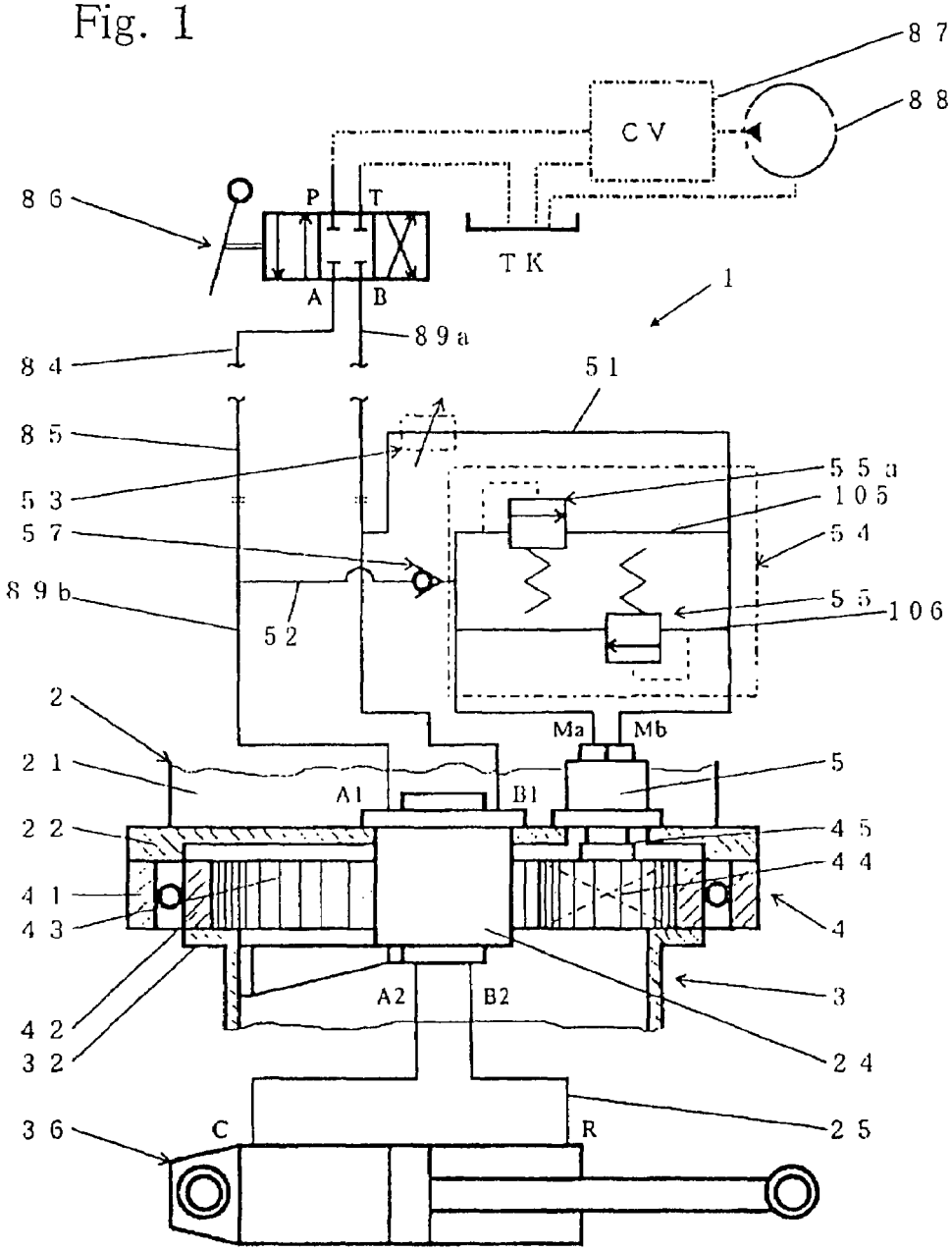
FIG. 1 is a diagram of a hydraulic circuit including relevant parts and operating for a crushing apparatus provided in a first embodiment of the present invention.

The crushing apparatus 1 shown in FIGS. 1 and 8 comprises the swiveling hydraulic motor 5. The motor 5 is fixed on a horizontal plate 22 of the bracket 2, though it may otherwise be secured to the bracket itself or to the frame. An inner race 42 of the swiveling bearing for this crushing apparatus 1 is fixed on the frame 3, and a circular rack 43 is engraved in the inner periphery of said inner race 42. A pinion 44 in mesh with the rack 43 is fixed to a shaft of the hydraulic motor 5. If the motor 5 is fixedly attached to the bracket 2, then a pair of crushing arms 33 and the frame 3 will rotate horizontally and relative to the bracket 2 when the motor 5 rotates.

Branches 51 and 52 leading to the swiveling motor 5 disposed in the bracket 2 are diverged respectively from forward or rearward main hydraulic paths 89*a* and 89*b*, that are connected to a hydraulic cylinder 36 for closing or opening the arms. When the arms are to be opened, the main path 89*b* will feed a hydraulic fluid (for example, oil) to the cylinder, with the other main path 89*a* feeding the hydraulic fluid when the arms are to be closed. A relieving throttle valve 53 is disposed in the branch 51 diverging from the arm-opening path 89*b*, and a check valve 57 is disposed in the other branch 52 from the arm-closing path 89*a*. An impacting-pressure bypassing means 54 (enclosed with a dot-and-dash line) intervenes between the branches 51 and 52. Particularly, this means 54 is disposed between the throttle valve 53 and one of hydraulic ports (Mb) of the motor 5, and also between the check valve 57 and the other port (Ma).

Figure 2:
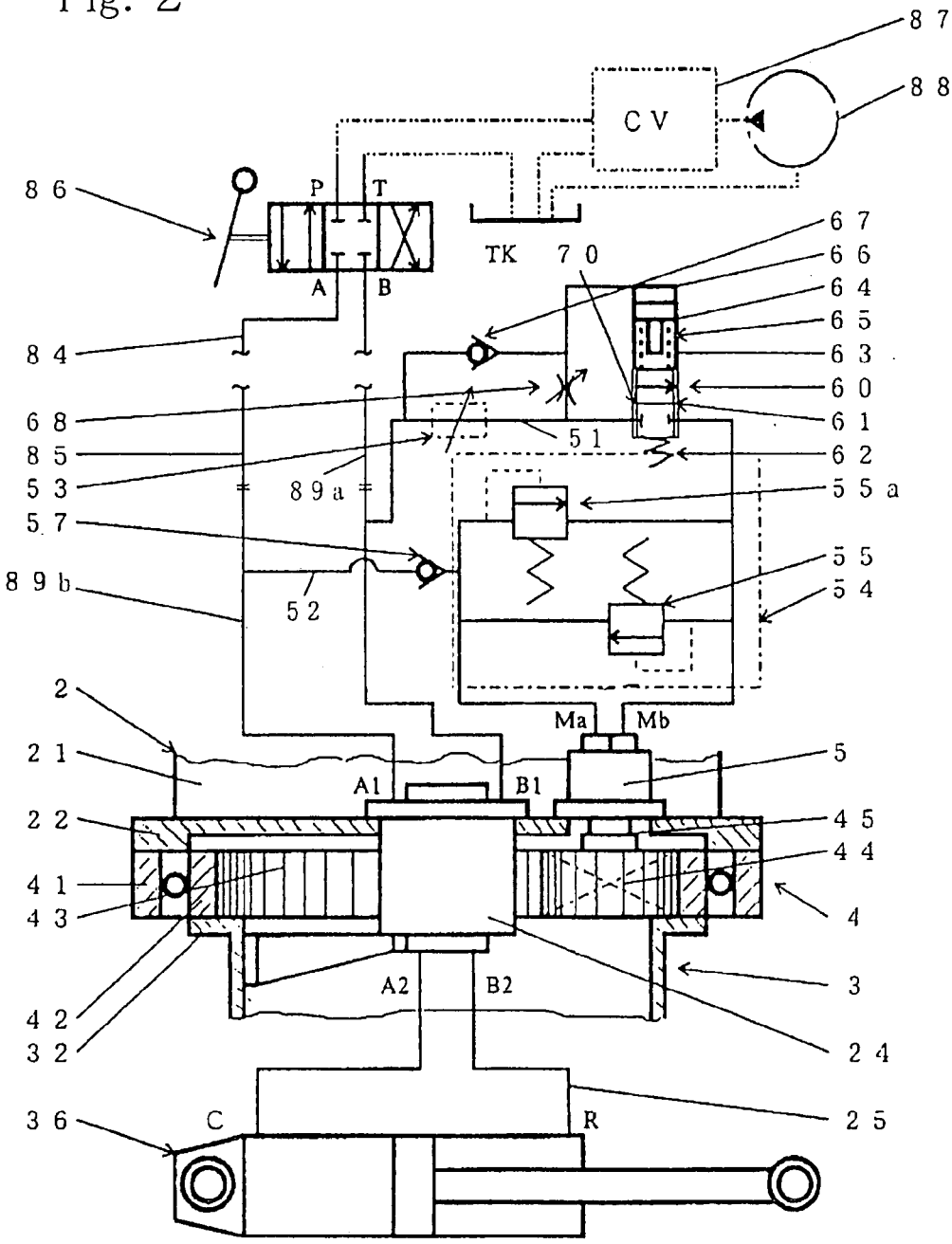
FIG. 2 is another diagram of a hydraulic circuit including relevant parts and operating for a crushing apparatus provided in a second embodiment.
Figure 3:
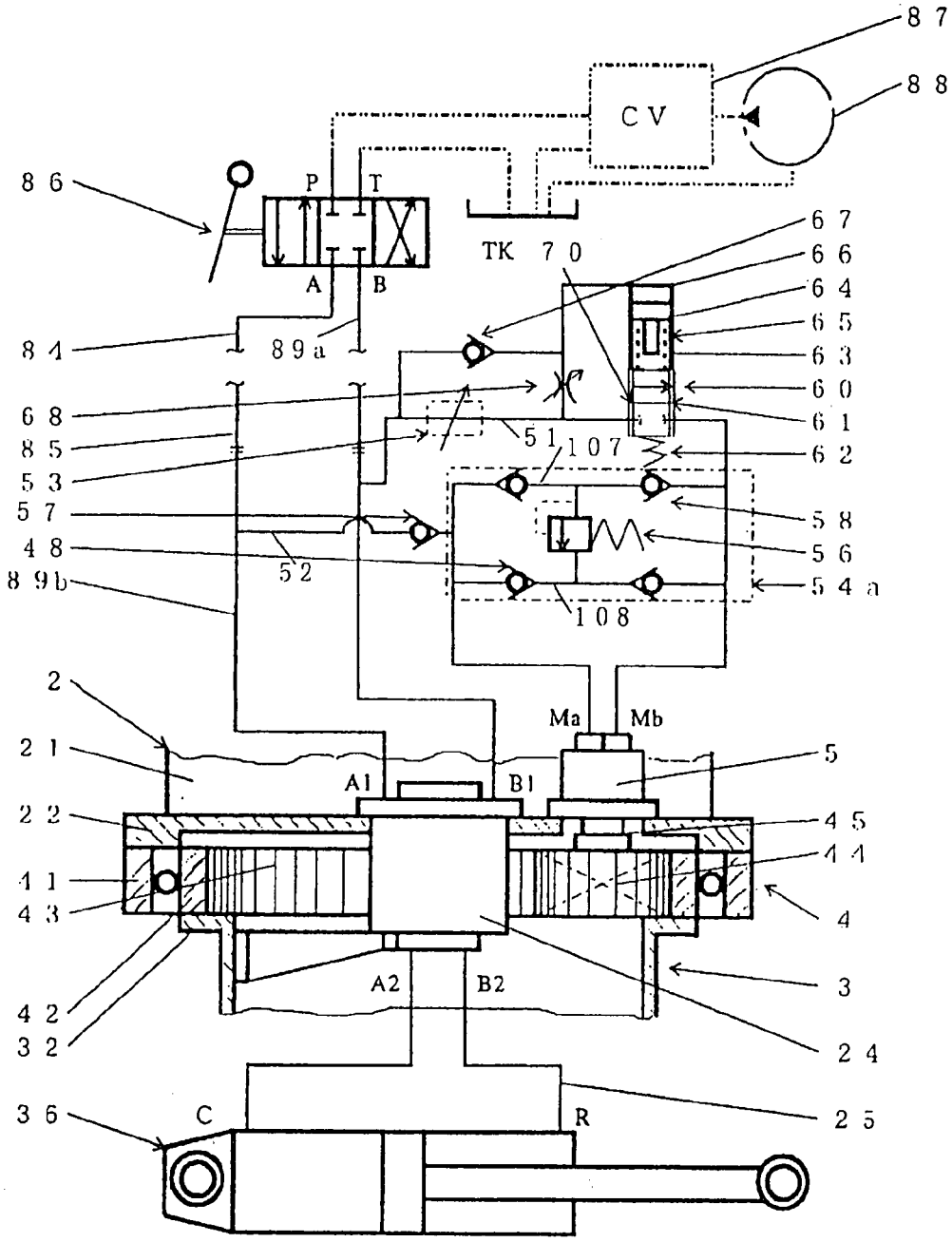
FIG. 3 is still another diagram of a hydraulic circuit including relevant parts and operating for a crushing apparatus provided in a third embodiment.

As shown in the hydraulic circuit of FIG. 2 or 3, a retarding means 60 for causing a delayed or interrupted opening of a hydraulic passage may be incorporated between the throttle valve 53 and motor 5. This means 60 will open the passage when a given length of time will have lapsed after the branch 51 leading to the motor 5 began to receive a hydraulic fluid flow. The opening motion of a switch-over valve 70 as a principal part of the retarding means 60 may be delayed to any desired extent by enlarging the volume of a pilot chamber 66, increasing a gap between a piston 64 and a spool 61, and/or constricting a throttle 68.

Figure 4:
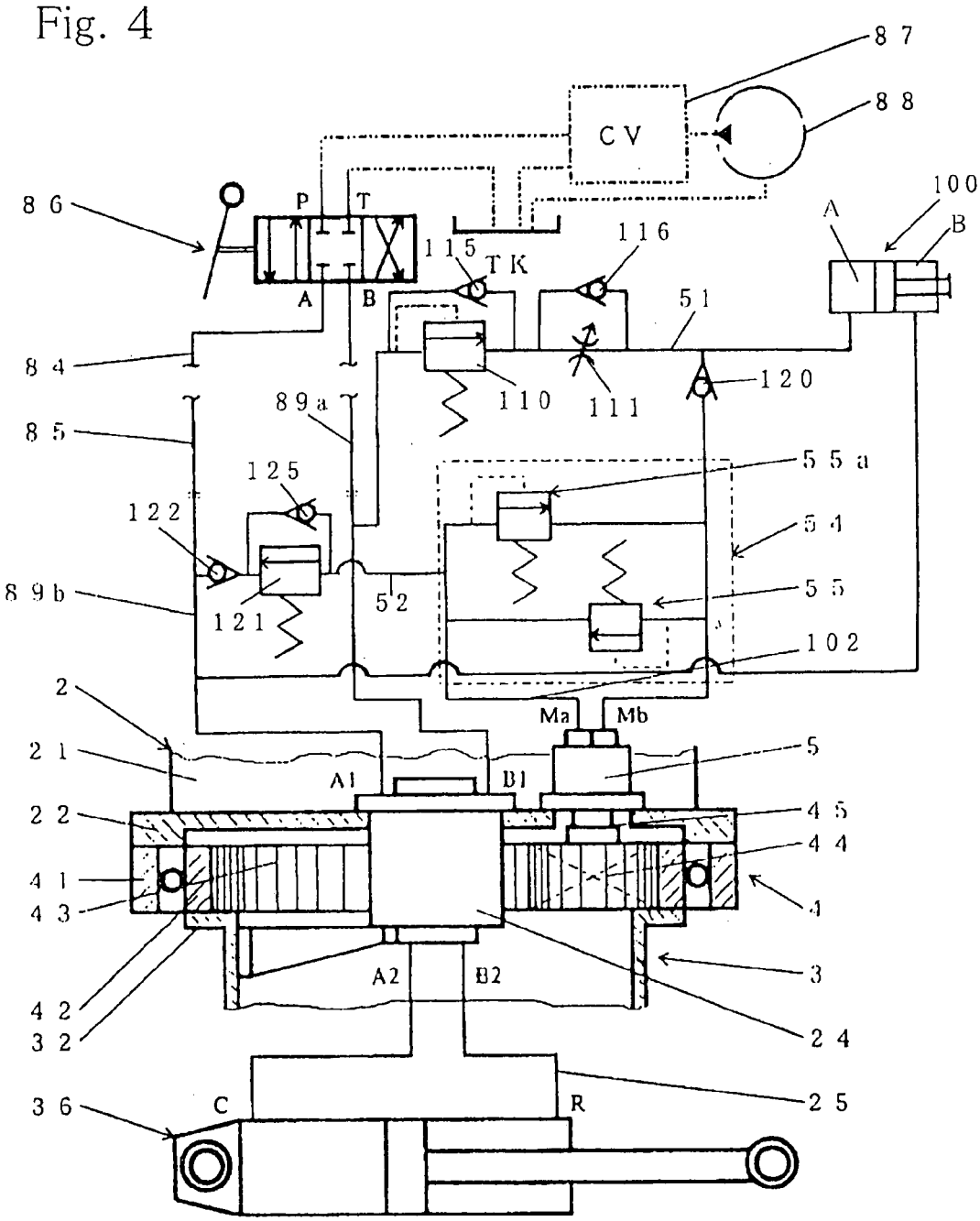
FIG. 4 is yet still another diagram of a hydraulic circuit including relevant parts and operating for a crushing apparatus provided in a fourth embodiment.

In place of the retarding means 60 shown in FIGS. 2 and 3, another type of retarding means 100 consisting of a non-loaded or light-loaded cylinder may be employed such that it stands parallel with motor 5 as seen in FIG. 4.

Figure 9:
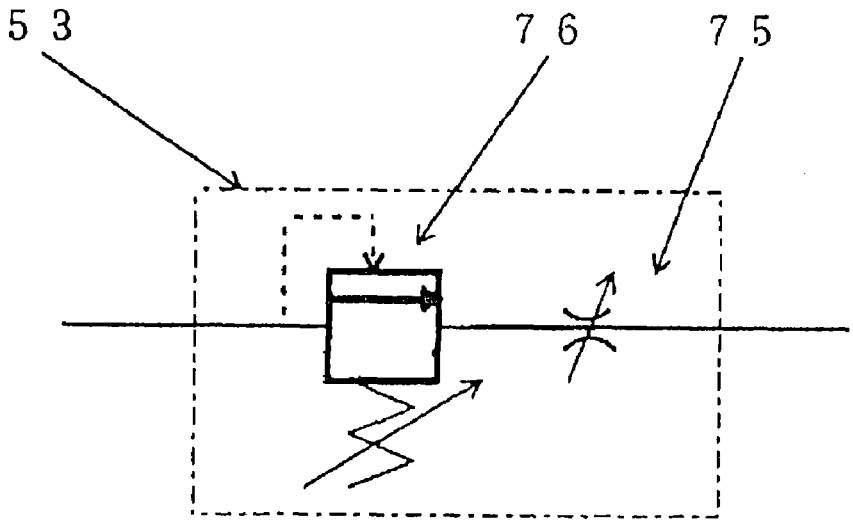
FIG. 9 shows a fragmentary hydraulic circuit including a relieving throttle valve.
Figure 10:
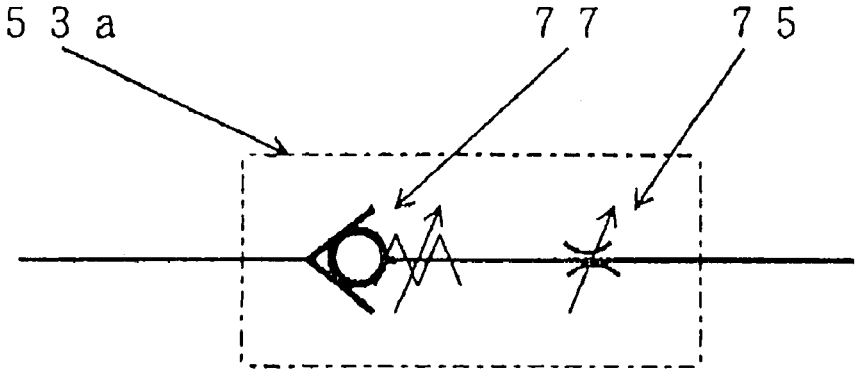
FIG. 10 also shows a likewise fragmentary hydraulic circuit including the relieving throttle valve in a modified type.

The composite relieving throttle valve 53 may be formed, as shown in FIG. 9, of a variable throttle 75 and a variable relief valve 76 connected in series thereto as in the prior art. Alternatively, the throttle valve 53*a* may be formed of the variable throttle 75 and a check valve 77 whose cracking pressure is variable, as shown in FIG. 10. In any case, the throttle valve 53 will effect its relieving function if and when the fluid pressure in the cylinder 36 will have been boosted after the cylinder stopped at a point for fully opening the crushing arms 33. The branch thus opened will function to feed a hydraulic fluid flow to the motor 5, at an appropriate flow rate which the throttle valve 53 is then controlling.

The impacting-pressure bypassing means 54 is composed of bypass lines 105 and 106 arranged in parallel with each other and both extending be-tween the branches 51 and 52. Variable relief valves 55 and 55*a* respec-tively disposed in these bypass lines 106 and 105 do face in opposite directions one against another. FIG. 3 shows an alternative example of the impacting-pressure bypassing means 54*a* comprising an fluid passage 107 (bypass line 'A') and another one 108 (bypass line 'B') between the branches 51 and 52. The passage 107 communicates with a higher-pressure side through a pair of first check valves 58, with the other passage 108 communicating with a lower-pressure side through a pair of second check valves 48. A bridging path provides a fluid communication of a intermediate point between the first check valves 58 with another intermediate point between the second ones 48. A variable relief valve 56 is disposed in this communication path, in a direction from the higher-pressure side to the lower-pressure side.

The impacting-pressure bypassing means 54 or 54*a* will function to relieve to the lower-pressure side an impacting excessive or extreme pressure that may appear on the higher-pressure side when the swiveling motion stops or any accidental overload happens. Thus, even if such an impacting pressure would appear in either one of fluid paths 89*a* and 89*b*, it will be relieved to the other path so as to protect the motor and the other hydraulic devices from breakage.

Figure 5:
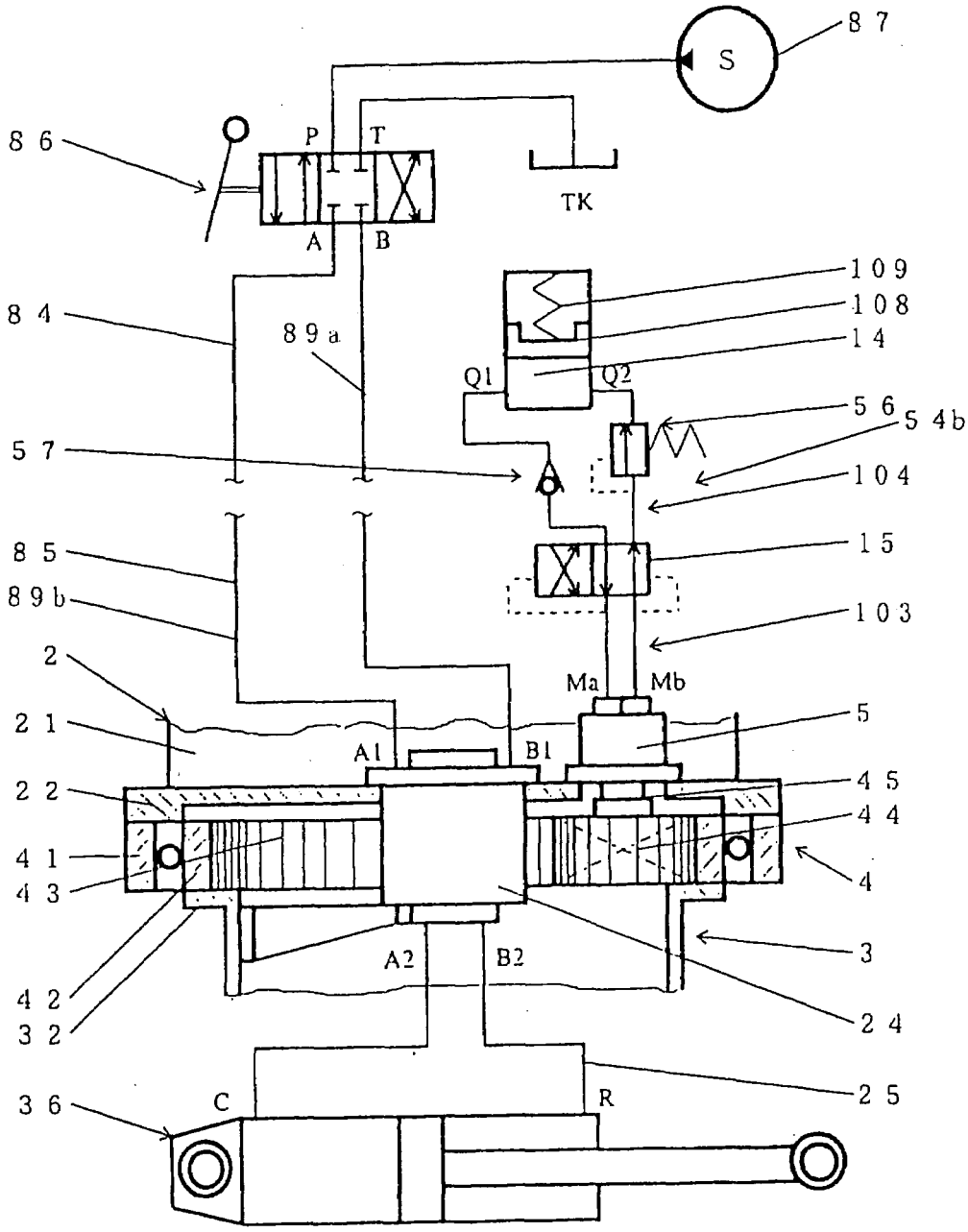
FIG. 5 is a further diagram of a hydraulic circuit including relevant parts and operating for a crushing apparatus provided in a fifth embodiment.

In alternative modes, any of the impacting-pressure bypassing means 54*b*, 54*c* and 54*d* may be employed instead of using those noted above. In the bypassing means 54*b* of FIG. 5, a bypass line 103 connects an inlet port Ma to an outlet port Mb of motor 5 in fluid communication with the inlet port. A pilot switch-over valve 15 is disposed in the bypass line 103 as seen in FIG. 5, in such a manner that the ports Ma and Mb are connected to respective valve ports corresponding to opposite ends of a spool of the valve 15. In the event that the motor 5 would be forced to rotate to an excessive extent, it will automatically be judged which port is then on a suction side or on an exhaustion side. Connected to the exhaustion side port (for instance Mb) via the pilot switch-over valve are a variable relief valve 56 (as a resistance), a fluid reservoir 14 and a check valve 57, in this order. Thus, a relieved amount of hydraulic fluid will flow back through the valve 15 and suction side port (for instance Ma) and return into the hydraulic motor 5.

The structure illustrated in FIG. 5 is an alternative mode such that the crushing end arms are pressed against a foreign obstacle so as to be forced to rotate, wherein the hydraulic motor 5 is used as a resistance or brake acting against such a forced rotation.

In this case shown in FIG. 5, a torsion stress will be imparted to the crushing apparatus that has gripped a target article and is then forcibly swiveling, with its end arms being pressed on any other article. Consequently, the motor 5 will receive a torque through the pinion 44 in mesh with the circular rack 43 of the swiveling bearing 4. The exhaustion side port Mb of the motor 5 will then exert a pressure to automatically change the position of switch-over valve 15 so as to communicate with the variable relief valve 56. As the pressure applied to the relief valve 56 rises above a limit, it will relieve a flow of hydraulic fluid into the bypass line, whereby the motor 5 starts to rotate causing the frame 3 of crushing apparatus 1 to swivel against a certain braking force.

The pilot switch-over valve 15 is exemplified in FIG. 5 as a two-position four-way valve enabling a parallel connection and a crossed connection. However, it may have a middle full closed position to be of a three-position four-way type as seen in FIG. 7, wherein the check valve 57 (in FIG. 5) is dispensed with.

Figure 6:
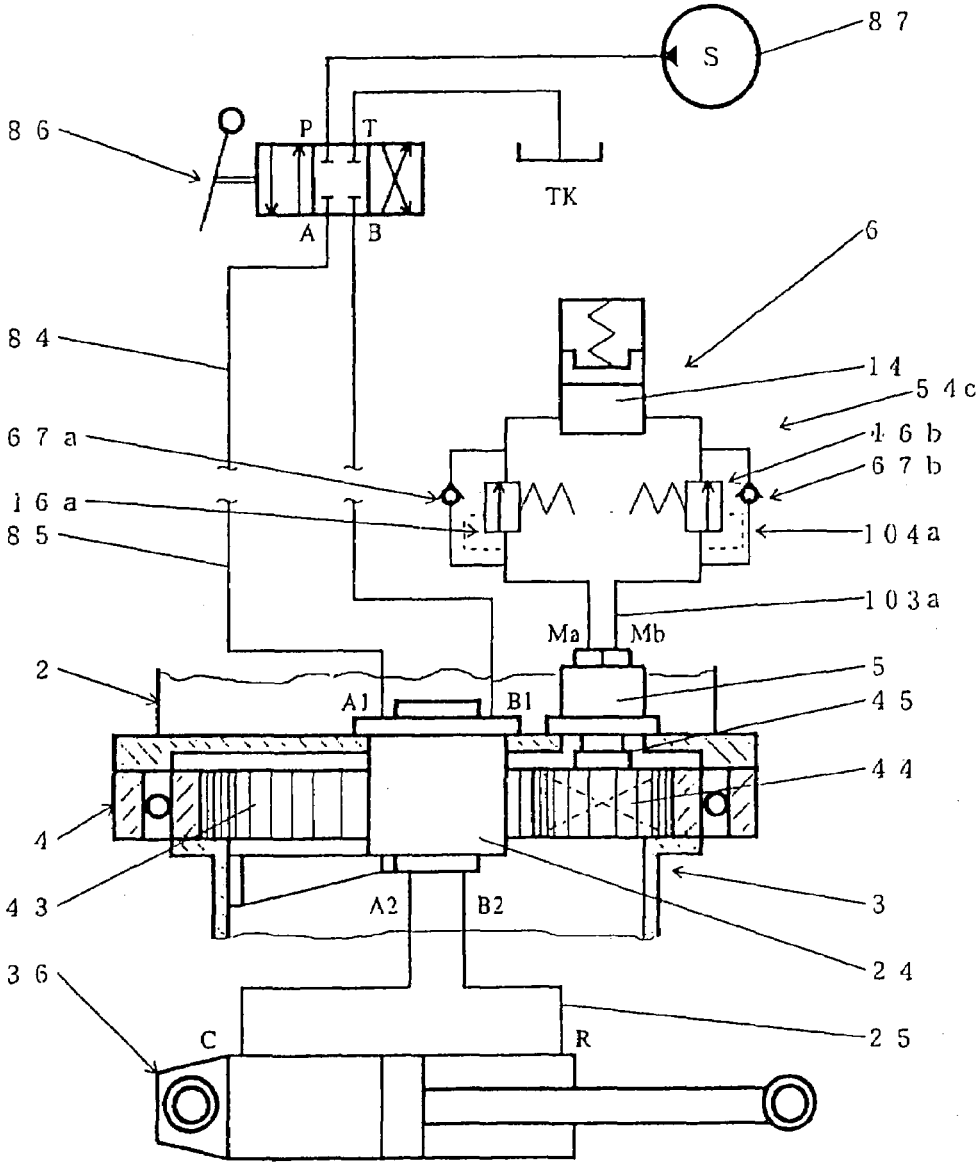
FIG. 6 is a still further diagram of a hydraulic circuit including relevant parts and operating for a crushing apparatus provided in a sixth embodiment.

The bypass line for hydraulic motor 5 may not necessarily be formed in the manner as described above, but be modified in many ways as exemplified in FIG. 6. In this example, the suction and exhaustion ports of motor 5 are connected respectively to variable one-way resisting means each consisting of a variable relief valve 16*a* or 16*b* and a check valve 67*a* or 67*b* disposed in parallel therewith. These check valves permit a fluid flow towards the motor only. Distal ends of such one-way resisting means may communicate with each other via a fluid reservoir 14. Although the pilot switch-over valve of FIG. 5 is dispensed with in this case, the variable relief valve 16*a* or 16*b* in either resisting means will exert a resistance against a flow from one Mb of the motor's ports, which is then acting as an exhaustion port. In harmony with this, the check valve in the other resisting means will allow the hydraulic fluid to freely return to the motor through the suction port Ma.

Figure 7:
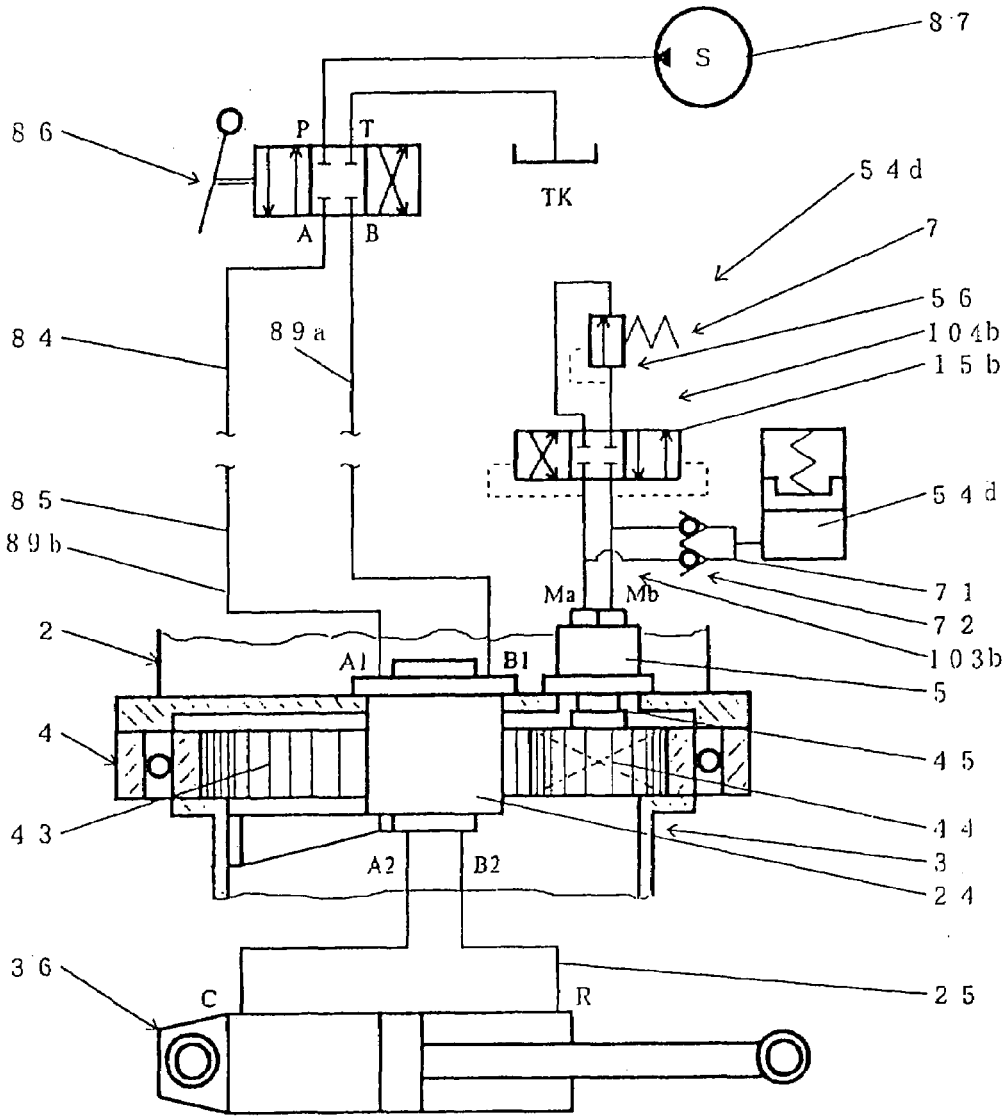
FIG. 7 is a yet still further diagram of a hydraulic circuit including relevant parts and operating for a crushing apparatus provided in a seventh embodiment.

Also alternatively, a hydraulic circuit as shown in FIG. 7 may be employed wherein a pilot switch-over valve 15*b* is used to automatically determine which of the suction and exhaustion ports of motor 5 is then functioning as a higher-pressure port. The higher-pressure port of the switch-over valve 15*b* will consequently be directed through a variable relief valve 56 to the lower-pressure port of this valve 15*b*. A bypass line 103*b* communicating with both the motor 5 and valve 15*b* does comprise a pair of fluid-replenishing paths 71, 71 each having disposed therein a check valve 72. These check valves 72 will prevent the high-pressure hydraulic fluid from flowing back into the chamber 54*d* of a discrete fluid reservoir 14, though the motor's ports are in communication with the fluid-replenishing paths 71.

Expansion/shrinking or leakage due to change in environmental temperature, as well as compression of a hydraulic fluid, may cause an excess or deficiency in the amount of fluid in the bypass line 103*b*. The fluid reservoir 14 communicating with this bypass line will compensate any excess or deficiency almost completely. However, a compressing means may preferably be incorporated in the reservoir 14 in order that deficiency is more surely compensated to avoid cavitation.

As is illustrated in FIGS. 5, 6, 7, the compressing means may comprise a piston 108 fitted in a cylinder and having a rear face urged forwards by a spring 109, thereby compressing the fluid within the chamber (of reservoir 14). This spring may be replaced by an amount of proper gas, or alter-natively a flexible plug containing an amount of gas sealed therein may substitute for the combination of piston 108 and spring 109.

Generally in operation of each of the crushing apparatuses 1 shown in FIGS. 1 to 4, a maneuverable control valve 86 may be shifted at first to its crossed flow position so that a hydraulic fluid flow will be delivered from one of ports 'B' of this valve to a swivel joint 24. This will then advance through said joint 24 and to enter the arm-closing/opening cylinder 36, through its port 'R' opened to face a piston rod fitted in this cylinder. While the piston rod is thus being retracted to open the crushing end arms 33 and 33, without encountering any resisting load, the pressure of hydraulic fluid will remain low enough to keep closed the relieving throttle valve 53 in the hydraulic circuit for the swiveling motor 5.

After the arms have opened fully, the pressure of hydraulic fluid flow from the control valve will start to rise so that the relief valve 76 (see FIG. 9) in the throttle valve assembly 53 is consequently opened. As a result, the branch 51 leading to the port Mb of the motor 5 will be supplied with the hydraulic fluid, driving the motor 5 to swivel the arms 33 of this crushing apparatus 1. The variable throttle valve 75 in said valve assembly 53 will regulate the rate of hydraulic fluid flowing into the motor 5 so as to make it rotate at a moderate speed. On the other hand, the other port Ma of the motor 5 communicates with the return path 89 from the cylinder 36, through the check valve 57 in the other branch 52. Therefore, the returning fluid effluent from the motor 5 will advance from the port Ma to a tank 'TK', via port 'A' of the maneuverable control valve 86.

Upon swivel of the arms 33 to a desired angle, the maneuverable control valve 86 will be shifted to its neutral position in order to stop the flow of hydraulic fluid through this valve, thereby stopping swiveling of the arms. Next, the working platform or truck will be operated in such a manner that its crushing apparatus 1 have the arms 33 engaged with a building's portion to be broken. Then, the maneuverable control valve 86 will be shifted to a parallel flow position so that the hydraulic fluid flows out of the port 'A' of this valve and into the cylinder 36 through its head-side port 'C'. As a result, the piston rod of this cylinder will extend out to close the arms 33, causing same to crush the building's portion. In spite of a rise in the hydraulic pressure during this process, the check valve 57 will inhibit the fluid from flowing towards the motor 5, so as to prevent it from rotating.

Further, the crushing apparatus's arms will be driven by the maneuverable valve 86 to repeat their closing and opening motions, so as to accomplish the crushing operation. If the valve 86 is operated to shift back to its neutral position or further to its parallel flow position just after or just before the full opening of arms 33, any feed of hydraulic fluid to the motor 5 will be interrupted not to rotate them at all.

It is possible that an abnormally high (shocking) pressure appearing in the hydraulic circuit in stopping the motor 5, or an extreme torsion from which the apparatus 1 suffers during its crushing operation, might cause a shock to the motor or charge it with an excessive load. In this event, the impacting-pressure bypassing means 54 will operate to relieve such an abnormally high pressure to the lower-pressure side. Whether the port Ma or the port Mb does stand then on the higher-pressure side, the variable relief valve 55 or 55*a* will relieve the high pressure from the former to the latter port, or vice versa. Thus, the motor 5 and other devices are protected well from any possible shock or overload.

As seen in FIG. 2, the retarding means 60 may be incorporated in the hydraulic circuit. In this case, the switch-over valve 70 continues interruption of the circuit for a certain period of time after the throttle valve 53 will have enabled fluid circulation therethrough. The motor is thus prevent-ed from commencing its rotation simultaneously with the opening of said throttle valve 53. In the retarding means 60, a narrow throttle 68 will direct a hydraulic fluid flow to the pilot chamber 66 at a gentle rate, until the amount of fluid thus accumulated in this chamber does push the spool 61 to open switch-over valve 70. This means that the arms 33 of the crushing apparatus 1 do begin their swivel late a little after they have opened fully. If the arms need not to swivel, then the maneuverable valve 86 may be shifted to its neutral position before the fluid starts to circulate through retarding means 60.

As shown in FIG. 4, the retarding means 100 of a cylindrical type may be employed instead of using that 60 discussed above. In this case, the hydraulic fluid will flow preferentially into the cylinder functioning as said means 100. One of its expansible chambers is thus filled at first with the fluid to fully extend outwards, so that the fluid will subsequently be fed to the hydraulic motor 5. Also in this case, the switch-over valve continues interrupt-ion of the circuit for a certain period of time after the throttle valve will have enabled fluid circulation therethrough. The motor 5 is thus prevented from commencing its rotation simulta-neously with the opening of said throttle valve.

With the maneuverable valve 86 being shifted to its neutral position or to its parallel flow position (for closing the arms), the check valve 57 will interrupt the fluid feed to the motor 5. In a case wherein the retarding means 60 is incorporated, its pilot chamber 66 will communicate back-wards with the return path 89*a* through the check valve 67, thereby making switch-over valve 70 restore its home posi-tion to more surely prevent fluid feed to the motor 5.

Embodiments now detailed below will make more appar-ent the invention, but not restricting its scope. As exempli-fied in FIG. 8, the crushing apparatus 1 comprising the hydraulic circuit as discussed above does have the pair of crushing arms 33, whose middle portions are pivoted at respective pins 38 to the frame 3. Proximal ends of crushing arms 33 are connected by further pins 37 to the hydraulic cylinder 36, such that distal ends of said arms are closed towards or opened away from each other as the piston rod of this cylinder 36 is extended or retracted.

The crushing apparatus 1 may be mounted on a hydraulic power shovel body (not shown) having a working arm 81 and a hydraulic cylinder 83 disposed thereon. A piston rod of this cylinder operatively connected to the apparatus 1 through a bucket link 82 will be extended or retracted to swing the apparatus 1 fore and aft to take any desired angular position. As will be seen in FIGS. 1 and 4, the fluid feed and return paths extend from a hydraulic source 88 and pass through the maneuverable valve 86 so as to form a pair of external pipes 84 continuing to a pair of respective proximal hoses 85. These distal hoses in turn continue to respective internal paths 89 disposed in the bracket and penetrating the swivel joint 24. This joint is disposed cen-trally of the swivel bearing 4, and the internal paths 89 continue to respective distal hoses 25 connected to the hydraulic cylinder 36. Thus, a series of forward fluid circuit segments start from the source 88 and reach the cylinder, whilst another series of rearward and complementary seg-ments start from the cylinder so as to return to the tank 'TK'. The source 88 of hydraulic fluid is used also as a power source for driving the power shovel body (though not shown) and is connected by a main control valve 'CV' (87) to the maneuverable valve 86. The latter valve 86 that may be operated using a pedal (not shown) disposed in an operator cabin is a three-position four-way valve having the neutral position, the parallel flow and crossed flow positions. The hydraulic fluid that will be fed through the thus operated maneuverable valve 86 to the cylinder 36 does act to extend out or retract back its piston rod, thereby closing or opening the crushing arms 33.

The frame 3 for the crushing apparatus 1 is composed of a horizontal top plate 32 and a pair of vertical side walls 31 secured thereto and depending therefrom. The bracket 2 overlying such a frame 3 is composed of a pair of side plates 21 fixed on a horizontal bottom plate 22, and each side plate has apertures formed in its upper region. Pins 23 fitted and fixed in these apertures function to connect the apparatus 1 to distal ends of the working arm 81 and the bucket link 82 so that the apparatus can swivel fore and aft relative to the distal end of said arm. An outer race 41 of swivel bearing is secured to the fringe of horizontal bottom 22 of bracket 2, with the inner race 42 of said bearing being secured to the fringe of top plate 32 of frame 3. A number of balls or short rollers are retained in between the outer and inner races to form the swivel bearing 4, thus rendering these races 41, 42 capable of relative rotation.

As shown in FIG. 1, the motor 5 for swiveling the apparatus is fixed on and to the top plate 22 of the bracket 2, and the pinion 44 is firmly secured to a projected portion of the motor's shaft 45. This pinion 44 is in mesh with the circular rack 43 engraved in the inner race 42 as already mentioned above. Thus, the frame 3 is capable of rotation in unison with the crushing arms 33, horizontally and relative to the bracket 2.

The ports Ma and Mb of motor 5 are connected in fluid communication to branches 51 and 52 that diverge respectively from the internal paths 89, 89 within the bracket. One of these branches 51 having the relieving throttle valve 53 disposed therein does continue to a first length of pipe that leads to the piston-side port of the cylinder 36. In contrast, the other branch 52 having the check valve 57 disposed therein does continue to a second length of pipe leading to the head-side port of the cylinder 36. The check valve 57 prevents the hydraulic fluid from flowing towards the motor 5. The impacting-pressure bypassing means 54 that intervenes between the first and second lengths of pipe is located between the throttle valve 53 and motor 5, from a first viewpoint, and also between the check valve 57 and motor 5, from a second viewpoint.

The relieving throttle valve 53 is a circuit element that will not only inhibit the fluid from flowing through it if the pressure appearing upstreamly of the valve is lower than a threshold, but also restrict the flow rate of the fluid even if it is allowed to flow through the valve. For example, this valve 53 is a composite element as shown in FIG. 9 that is a combination of the variable throttle valve 75 with the variable relief valve 76 connected thereto in series. In an alternative example shown in FIG. 10, the relieving throttle valve 53 is another composite element 53*a* consisting of the variable throttle valve 75 combined with a check valve 77 in series.

The impacting-pressure bypassing means 54 comprises a first and second parallel bypass lines that are spanned each between the branch 51 leading to port Mb and the other branch 52 leading to port Ma of the hydraulic motor 5. The variable relief valve 55 disposed in the first bypass line permits the fluid to flow from the branch 51 to branch 52, whereas the other variable relief valve 55*a* disposed in the second bypass line permits the fluid to flow from the branch 52 to branch 51. By virtue of presence of such a means 54, any impacting or extreme pressure appearing at either of port Ma or Mb will be relieved to the other port Mb or Ma, or vice versa.

MORE DETAILS IN OPERATION will now be given, denoting the circuit elements and portions with the reference numerals only and showing the order with arrow symbols (→). With the maneuverable control valve 86 shown in FIG. 1 being shifted to its parallel flow position, the hydraulic fluid from hydraulic source 88 will flow to→'P'→'A'→one 84→one 85→89*b*→A1→A2→'C', in this order. On the other hand, the other flow of the fluid from the rod-side port 'R' of cylinder 36 will advance to→B2→B1→89*a*→ the other 85→ the other 84→'B'→'T', also in this order, before returning into the tank 'TK'. Resultant extension of the piston rod of cylinder 36 will displace the crushing arms 33 towards each other so as to close them. With the maneuverable control valve 86 being shifted to its crossed flow position, the hydraulic fluid from hydraulic source 88 will flow to→'P'→'B'→the other 84→the other 85→ 89*a* →B1→B2→'R', in this order. On the other hand, the other flow of fluid from the rod-side port 'C' of cylinder 36 will advance to→A2→A1→89*b*→the one 85→the one 84→'A'→'T', also in this order, before returning into the tank 'TK'. Resultant retraction of the piston rod of cylinder 36 will open the crushing arms 33 away from each other.

With the crushing arms 33 being kept full open as just mentioned, the pedal for actuating the maneuverable valve 86 may be held in a depressed state so as to continue fluid feed to the cylinder 36. Consequently, hydraulic pressure will rise in the internal paths 89 and the branch 51 to exceed a limit that has been preset in and for the throttle valve 53. As a result, the variable relief valve 76 (FIG. 9) or the check valve 77 varying the cracking pressure (FIG. 10) will open so that the feeding of fluid to the motor 5 will begin. The variable throttle valve 75 (FIG. 9 or 10) regulates the flow rate of fluid thus being delivered to motor, so that it will not rotate at any undesirably high speed but will rotate at a moderate speed.

It will now be apparent that the hydraulic motor 5 swivels the crushing apparatus 1 to any desired angular position, and the power shovel body and its bucket link 82 are operable to cause the crushing apparatus to take any desired spatial posture. At the thus selected position and posture, the crushing arms 33 may be opened and closed to crush any concrete blocks or the like. The maneuverable valve 86 may be held in one of its states to further open the arms that have been opened fully, whereby the apparatus 1 will swivel further an angle to adjust its position. Even if any extremely high pressure would appear in either branch 51 or 52 when stopping the swiveling motion or during the crushing work, the impacting-pressure bypassing means 54 will instantly absorb such an extra pressure so as to protect the motor 5 from damage.

FIG. 2 shows a second embodiment, wherein the retarding means 60 is disposed in the branch 51 in order to delay or interrupt a while the feeding of hydraulic fluid to the motor 5 after the arms 33 have opened fully. This retarding means is interposed between the motor 5 and the relieving throttle valve 53.

The switch-over valve 70 built in the retarding means 60 comprise a spool 61 that has an interrupting position at which the hydraulic fluid flow will be interrupted, and a through-flow position at which the fluid is allowed to pass through this valve. A spring 62 acting on one end of the spool 61 is biasing it always towards the interrupting position, and an urging means 65 having a pilot chamber 66 is disposed in contact with the other end of said spool. The urging means 65 is composed of a cylinder defining therein the chamber 66, a piston 64 sliding in the cylinder, and a coiled spring 63 for urging the piston so as to discharge the fluid in the chamber 66. Unless any positive pressure is present in pilot chamber 66, the spring 63 will hold the piston 64 up a proper distance away from the said other end of spool 61.

A side passage having a further throttle valve 68 does connect the inlet port of the switch-over valve 70 to the pilot chamber 66 in fluid communication. This chamber does also communicate with an upstream side of the first mentioned throttle valve 53 through a check valve 67, in order to return to the branch an amount of fluid exuded from the pilot chamber.

If and when the composite relieving throttle valve 53 in the circuit of FIG. 2 is forced to open due to a positive hydraulic pressure of the hydraulic fluid, the switch-over valve 70 will be exposed to this pressure. Simultaneously, the fluid will flow through the throttle valve 68 into the pilot chamber 66, so that the piston 64 is pressed downwards (in the drawings) for a time which the displacement of piston rod will take to bring its lower end into contact with the spool's upper end. Thus, the spool 61 will commence its downward motion to subsequently open the switch-over valve 70, by shifting it to take a position where the hydraulic fluid can flow towards the motor 5. Resultant rotations of this motor will drive the apparatus 1 to swivel its crushing arms 33.

The retarding means 60 just discussed above may be designed such that its pilot chamber 66 is enlarged, with the gap between its piston 64 and spool 61 being increased and with the throttle valve 68 being narrowed. This design will be useful to prolong the delayed time which the switch-over valve 70 takes to come into its open position. In this way, any preferable length of time can be selected and employed between the preceding timing at which the arms 33 are opened fully and the succeeding timing at which they swing in unison. By virtue of this feature, it is possible to separately control the crushing operation and the swiveling motion of the arms, thereby rendering easier and more efficient the crushing works which the present apparatus has to do.

FIG. 3 shows a modification of the circuit comprising the retarding means 60 of FIG. 2, wherein the impacting-pressure bypassing means 54*a* is of different structure from that 54 already described above. This means 54*a* comprises two fluid passages 107 and 108 both spanned between the branch 51 leading to port Mb and the other branch 52 leading to port Ma of the motor 5. The first check valves 58 disposed in one of the passages 107 are arranged face-to-face so as to receive fluid flow from either branch 51 or 52. The second check valves 48 disposed in the other passages 108 are arranged back-to-back so as to flow the fluid either into the branch 51 or 52. A fluid communication path is connected to an intermediate point between the first check valves 58 and also to another intermediate point between the second check valves 48. The variable relief valve 56 is disposed in this communication path, in such a direction that the fluid can flow in between the second valves 48, from the higher-pressure zone appearing between the first valves 58.

In the impacting-pressure bypassing means 54*a* as modified above, whether any hydraulic shock or abnormally high pressure acts on one port Ma or on the other port Mb, an excessive amount of fluid will be relieved via one of the branches 52 or 51 into the other of the branches 51 or 52, through one of the check valves 58, relief valve 56 and one of the check valves 48. Thus, such an abnormal shock or pressure appearing at the one port is relieved toward the other port, also smoothly in this case.

FIG. 4 shows a further modification, in which the basic circuit of FIG. 1 is combined with a retarding means 100 of a different structure than that shown in FIG. 2.

The retarding means 100 comprises a cylinder that preferably operates almost freely without suffering from any noticeable resistance. It has to operate otherwise against a reduced resistance at worst, and which resistance is to be considerably weaker than that acting against rotations of the motor 5 disposed in parallel with this retarding means.

Also in this case, the ports Ma and Mb are connected to the branches 51 and 52 that diverge from the respective internal paths 89*a* and 89*b* disposed in the bracket. One of the branches 51 communicates with one of the paths 89*a* for the piston-rod side of arm-closing/opening cylinder 36, and a relief valve 110 and a throttle valve 111 are disposed in this branch 51. Each of relief and throttle valves 110 and 111 is accompanied by a bypass line having a check valve 115 or 116 disposed therein, and each of these check valves allows the fluid to flow from the upstream side to the downstream side of the valve 110 or 111.

The downstream side pipe of the throttle valve 111 diverges into two passages, one of them leading to the port Mb of motor 5, with the other to a chamber 'A' of cylinder 100.

The other passage from another chamber 'B' of cylinder 100 does directly communicate with the other path 89*b* extending from the cylinder-head side of arm-closing/opening cylinder 36.

On the other hand, the other port Ma of motor 5 is connected to the other branch 52 diverging from said path 89*b* extending from the cylinder's 36 head side. The branch 52 has a checking relief valve 121 and an ordinary check valve 122, both arranged in line in this branch. The ordinary check valve 122 inhibits the hydraulic fluid from flowing towards the motor 5, but will not open to the path 89*b* until the pressure on its upstream side exceeds a limit in this embodiment. However, the checking relief valve 121 permits the hydraulic fluid to flow towards the path 89*b* away from the motor 5, when the pressure on its upstream side exceeds the same or a different limit. A further check valve 125 bypassing the relief valve 121 allows the hydraulic fluid to flow towards the motor 5.

In this embodiment, the passage extending from the chamber 'B' of the retarding cylinder 100 directly communicates with the path 89*b* for the cylinder-head side of cylinder 36, as noted above. As the pressure in this side of cylinder 36 rises to close the arms 33, the hydraulic fluid will be accumulated in the chamber 'B' of cylinder 100.

In contrast with this, any ordinary crushing operation will never cause the fluid to flow into the other chamber 'A', since the other passage extending from this chamber 'A' of retarding cylinder 100 has the relief valve 110 disposed in said passage. Thus, normally only the chamber 'B' contains the fluid, with the other chamber 'A' remaining vacant to be ready for receiving the fluid as follows.

Similarly to the preceding embodiments, as the composite relieving throttle valve is opened to produce a fluid flow through the branch 51, the fluid will preferentially enter the chamber 'A' of the retarding cylinder 100. This is because this cylinder normally remains non-loaded, whereas a remarkable resistance is always acting against the motor 5 so as to render it 'loaded', viz., disable it to freely rotate. After the hydraulic fluid has saturated the chamber 'A', it will subsequently start to flow towards the motor 5. By virtue of this feature, it is possible to suitably adjust time length from the full open of the arms 33, 33 to the start of swiveling and to separately control the crushing operation and the swiveling motion of the arms, thereby rendering easier and more efficient the crushing works which the present apparatus has to do.

According to the hydraulic circuits employed in the foregoing embodiments discussed above, some of the constituent devices, parts or elements that have been necessary heretofore to the prior art piping for connecting the crushing apparatuses to any existing power shovel can now be dispensed with. Dispensable are: three pipe lines as the feed, return and drain paths for the power shovel, swivel-controlling valves and sub-circuits, swivel-actuating pedal and certain hoses for connecting the distal ends of pipe lines to a crushing apparatus. The piping cost will thus decrease to a remarkable degree, and further, only two connection hoses need to be attached to or detached from an existing power shovel joint within a much shorter time.

Each described hydraulic circuit for the crushing apparatus will enable any operator on a self-propelled working platform or truck to simply maneuver only the arm-closing/opening pedal, lever and the like whenever the apparatus has to be swiveled. The operator need not repeat to depress and release two or more pedals one after another when he or she swivels the crushing apparatus, thus saving his or her labor.

In the embodiments respectively shown in FIGS. 1 to 4, the hydraulic motor 5 works to 'positively' swivel the crushing apparatus. However, the present invention may also apply to another system in which the crushing apparatus is kept pressed against a proper and neighboring foreign article while the shovel body is turning an angle. In this case, the apparatus will make a 'forced' or 'dragging' swivel as will be understood from the following additional embodiments described referring to FIGS. 5 to 7.

A hydraulic circuit for the motor 5 in these additional embodiments is formed to be quite independent of the other circuit for closing/opening the crushing arms. The inlet and outlet port Ma and Mb are connected one to another through a bypass line 103, which has a variable resisting means 104 and a fluid reservoir 14 disposed therein. This means 104 will operate for either port Ma or Mb that is then acting temporarily as the outlet port, and the reservoir 14 communicates with the temporary inlet port Mb or Ma. This circuit will apply the same moderate resistance to the motor 5, whether it rotates in a forward or reversed direction, while automatically avoid any surplus of or deficiency in the hydraulic fluid resulting from change of conditions in each zone of the circuit.

Some examples of these variable resisting means and fluid reservoir will be given later.

Also in each of the crushing apparatuses shown in FIGS. 5 to 7, the maneuverable control valve 86 may be operated in the same manner and to produce the same effect as noted in the preceding embodiments shown in FIGS. 1 to 4. If it is shifted to its parallel flow position, then the fluid will flow from a hydraulic fluid source 'S' (87) and then to→'P'→'A'→89*b*→A1→A2→'C', in this order. Such a flow will cause extension of the piston rod of the cylinder 36 so as to close the distal ends 34 of crushing arms of this apparatus. Simultaneously, the fluid will flow in a reversed direction from the rod-side port 'R' of cylinder 36 and then→B2→B1→89*a*→'B'→'T', also in this order, before returning into the tank 'TK'.

With the maneuverable control valve 86 being shifted to its crossed flow position, the hydraulic fluid from hydraulic source will flow to→'P'→'B'→89*a*→B1→B2→'R', in this order. On the other hand, the fluid returns from the rod-side port 'C' of cylinder 36 and advances to →A2→A1→89*b*→'A'→'T', also in this order, before entering the tank 'TK'. Resultant retraction of the piston rod of cylinder 36 will open the distal ends 34 of crushing arms away from each other.

Any operator can optionally and easily close or open the crushing arm distal ends 34, by means of the maneuverable control valve 86.

To carry out a crushing work using the apparatus 1, its crushing arms have to be opened at first, before the power shovel body is turned an angle while the arms' distal ends are kept in contact with a target article or portion to be crushed. This step is called 'butting-turn' that is effective to preliminarily adjust the direction in which the arms will then be closed and opened one or more times. Further, the bucket cylinder 83 will be operated to actuate the bucket link 82 so that extension or retraction of the piston rod of this cylinder does adjust fore-and-aft angle of crushing apparatus 1, before placing its arms on the target article or portion. Subsequently, the crushing arms are closed towards each other to crushingly break said article or portion. The apparatus thus doing the crushing work will likely suffer from an angular torsion that is caused by an offset of the apparatus. However, the apparatus' body frame will make a forced swivel due to and in response to such an angular torsion so as to cancel it, thus spontaneously correcting the posture of said arms to swing in an accurate direction perpendicular to said target article.

If the 'butting-turn' or crushing operation results in a torsion forcing the apparatus' body frame to make a passive swivel, then the pinion 44 in mesh with the rack 43 formed on the inner periphery of the inner race of swivel bearing will actuate the hydraulic motor 5 to rotate. As a result, an amount of hydraulic fluid will be pushed into the bypass line 103 having the variable resisting means 104 installed therein. This means 104 cooperates with one of the motor's port Ma or Mb that is then acting temporarily as an outlet, so that resistance of a certain intensity will be produced against the motor whether it passively rotates clockwise or counterclockwise. A resultant negative torque which the motor 5 exerts will serve as a braking force acting on the crushing apparatus, so as to prevent the apparatus from swiveling freely.

Such an anti-swivel braking force will prevent the crushing arms from making any passive rotation that would otherwise be caused by the offset in gravitational center of said arms being closed or opened. Thus, the apparatus will maintain the swiveling angle preliminarily selected by the 'butting-turn', without showing any unallowable degree of rotation resulting from inertia.

The fluid reservoir 14 communicating with the bypass line will be useful to automatically compensate any surplus or deficiency that might appear due to the swiveling motion, any noticeable change in temperature and or any internal leakage of the fluid.

Now, some examples for embodying the combination of variable resisting means with the fluid reservoir will be described.

The bypass line 103 shown in FIG. 5 comprises a pilot switch-over valve 15 of the two-position four-way type, in which a parallel flow position and a crossed flow position are provided. This valve 15 will automatically detect which of the motor's 5 ports Ma and Mb is then acting as an outlet side (viz., higher-pressure side), with the other is acting as an inlet side. The bypass line 103 is composed of an exhaustion path and a return path, so that a variable relief valve 56 as the variable resisting means 104 is disposed in the exhaustion path to communicate with the higher-pressure side of motor 5. A check valve is disposed in the return path to communicate with the lower-pressure side so as to allow the fluid to flow only towards the motor, and the fluid reservoir 14 intervenes between this check valve and the down-stream opening of said relief valve 56. The fluid reservoir 14 is pressurized with a piston 108 urged thereto with a spring 109, thereby imparting a proper moderate pressure to the interior of return path communicating with the lower-pressure side port.

In this circuit, a temporarily outlet-sided port Ma or Mb will impart a pressure (along a broken line) to a spool of the pilot switch-over valve 15 in either direction, when the body frame receives a torque to urge the motor 5 to rotate in either direction. The spool thus displaced will bring the outlet side port Ma or Mb into a fluid communication with the relief valve 56 disposed in the exhaustion path. Once the pressure from the outlet side port reaches and exceeds a preset value, the fluid will be relieved through this valve so as to let the hydraulic motor 5 rotate, imparting a braking force to the apparatus. The relieved amount of fluid will thus advance through the ports Q2 and Q1 of reservoir 14, hence through the check valve 57 and the lower-pressure side port of switch-over valve 15, until returning to the inlet side port of motor 5.

Any surplus or deficiency of hydraulic fluid that may be caused by any change arising in the conditions of this circuit will be spontaneously canceled by the reservoir, and the biasing means installed therein will protect the motor 5 from cavitation that would result from its insufficient suction of fluid.

A bypass line 103*a* shown in FIG. 6 comprises two variable one-way resisting means 104*a* that are in fluid communication with the ports Ma, Mb, respectively. This means 104*a* is composed of a pair of variable relief valve 16*a* and check valve 67*a* arranged in parallel therewith. Each check valve 67*a* and 67*b* allows the fluid to flow only towards the motor. Both the relief valve and check valve in each pair lead to either port Ma or Mb, that is then standing on the inlet side or on the outlet side with respect to motor 5. Distal ends of such means 104*a* communicate with each other through the fluid reservoir 14. A piston 108 that is installed in the reservoir 14 and has a back urged forwards by a spring 109 will apply a proper pressure to the interior of this bypass line.

In this circuit, a temporarily outlet-sided port Ma or Mb will exert a positive pressure, when the body frame receives a torque to urge the motor 5 to rotate in either direction. Once the pressure from the outlet side port reaches and exceeds a preset value for the one-way resisting variable relief valve 16*a* or 16*b*, the fluid will be relieved through this valve so as to let the hydraulic motor 5 rotate, imparting a braking force to the apparatus. The relieved amount of fluid will thus advance through the check valve 67*b* or 67*a* of the one-way resisting means 57 so as to return to the inlet side port of motor 5. Also in this case, any surplus or deficiency of hydraulic fluid that may be caused by any change arising in the conditions of this circuit will be spontaneously canceled by the reservoir. The biasing means installed therein will protect the motor 5 from cavitation that would occur due to its insufficient suction of fluid.

A further bypass line 103*b* shown in FIG. 7 has a pilot switch-over pilot valve 15*b* of the three-position four-way type installed therein. This valve 15*b* will automatically be shifted between its three positions, that is a neutral, a parallel flow and crossed flow positions. Similarly to the other circuit as summarized above, this valve 15*b* will also detect automatically which of the motor's 5 ports Ma and Mb is then acting as an outlet side (viz., higher-pressure side), with the other is acting as an inlet side. A variable relief valve 56 acting as the resisting means has an inlet port connected to a higher-pressure outlet port of the valve 15*b*. The outlet port of the relief valve 56 leads directly to the lower-pressure side return port of said valve 15*b*. Both the paths extending between this valve 15*b* and the motor 5 have branches 71 each acting as a replenishing path that leads to a fluid reservoir 14 arranged beside the said paths. The reservoir is pressurized with a piston 108 urged thereto with a spring 109, thereby imparting a proper moderate pressure to the interior of return path communicating with the lower-pressure side port of the motor.

In this circuit, a temporarily outlet-sided port Ma or Mb will impart a pressure (along a broken line) to a spool of the pilot switch-over valve 15*b* in either direction, when the body frame receives a torque to urge the motor to rotate in either direction. The spool thus displaced will bring the outlet side port Ma or Mb into a fluid communication with the relief valve 56 disposed in the exhaustion path. Once the pressure from the outlet side port reaches and exceeds a preset value, the fluid will be relieved through this valve so as to let the hydraulic motor 5 rotate, imparting a braking force to the apparatus. The relieved amount of fluid will thus advance through the lower-pressure side port of the switch-over valve, returning to the inlet side port of motor 5.

Any surplus or deficiency of hydraulic fluid that may be caused by any change arising in the conditions of this circuit will be spontaneously canceled by the reservoir through either replenishing path 71. The biasing means installed therein will protect the motor 5 from cavitation that would result from its insufficient suction of fluid.

Generally, in operation of any crushing apparatus, its body frame will often be caused to swivel in order to protect it or the hydraulic power shovel body from any extreme twisting stress and strain that are likely to take place due to crushing motions. The apparatus must be maneuvered to take and keep its optimal position where it can crush a target article most efficiently. For this purpose, it should be prevented from making any unintended angular displacement that would be caused by interference with any obstacle or due to offset of its gravitational center. If the crushing arms have to change a direction in which they are closed or opened, then the power shovel body will be driven to make a 'butting-turn'. At this step of operation, the couple of crushing arms pressed against any pillar or wall are exactly displaced an angle to take their optimal posture or target position. During these steps of operation, the hydraulic motor 5 controlled in the manner detailed hereinbefore will inhibit the crushing apparatus from making any free and idle rotation. By virtue of the motor's stable and reliable braking force, all the operational steps can now be conducted smoothly and exactly.

The prior art braking systems such as the disc brake type do usually rely on mechanical friction. The loosening of a spring for urging a friction plate, the abrasion and rise in temperature thereof, any surplus or deficiency of lubricant oil as well as any foreign materials caught in the constituent parts, have often caused disorder in the braking mechanism. Therefore, frequent adjustment and/or repair of them have been unavoidable, though it requires mechanical skill to conduct very intricate, time-spending and labor-consuming works to be done in a narrow space. In view of these drawbacks in the prior art brakes, a variable resisting means including a relief valve or the like installed in line in a bypass line of hydraulic motor is provided herein to let the motor to generate a braking force so as to prevent its passive and excessive swiveling. The braking force can be adjusted exactly and easily by changing a hydraulic pressure acting in resisting means, being scarcely affected by any change in temperature that would impair stability and reliability of this system. No friction plate or the like that have shown quick abrasion is necessary any longer, thus the present braking system that need not be repaired for a long time is improved in durability. If hydraulic motors whose suction sides are of no positive pressure are forced to rotate, then the flow resistance inherent in the internal and upstream passages of said motors will produce a negative pressure therein. This problem is called 'cavitation' that will probably give the motors a serious damage, or break them. In order to avoid the 'cavitation' herein, the fluid reservoir has the compressing means incorporated therein and is installed in the bypass line connected to the hydraulic motor. This reservoir always applies a positive hydraulic pressure to the motor's suction side. Additionally, such a reservoir will also contribute to release of any braking heat, replenishment of fluid (to cover a leakage loss) and compensation of temporarily varying volume of the fluid (due to change in temperature). Thus an excellent braking mechanism that is capable of using an ordinary hydraulic motor as a braking means is achieved.

The invention claimed is:

1. A crushing apparatus that is attachable to a working arm of a self-propelled platform or truck, and that comprises crushing arms capable of being closed or opened by a hydraulic actuator as well as a swiveling mechanism having a hydraulic motor for driving the crushing arms to swivel, the crushing arms movable between a closed position and a fully open position;

the apparatus further comprising a branch diverged from a hydraulic fluid path communicating with the actuator for closing and opening the crushing arms, with this path feeding the hydraulic fluid to said actuator when the crushing arms are driven to open, and the branch having disposed therein an on-off means that normally keeps the branch closed, but will open this branch so as to drive the motor only when a pressure applied to the actuator rises above a predetermined level while the crushing arms remain opened, and a delay device incorporated in the branch such that when a pressure therein or in the hydraulic fluid path has exceeded a limit and a given period of delay time has lapsed, an amount of hydraulic fluid will be supplied to the swiveling mechanism after the crushing arms have fully opened.

2. A crushing apparatus as defined in claim 1, wherein the delay device is an additional hydraulic cylinder connected in parallel to the hydraulic swiveling motor.

3. A crushing apparatus as defined in claim 2, wherein the additional cylinder is actuated at a pressure lower than that at which the swiveling motor is actuated.

4. A crushing apparatus that is attachable to a working arm of a self-propelled platform or truck, and that comprises crushing arms capable of being closed or opened by a hydraulic actuator as well as a swiveling mechanism having a hydraulic swiveling motor for driving the crushing arms to swivel, the crushing arms movable between a closed position and a fully open position;

the apparatus further comprising in addition to hydraulic fluid paths respectively continuing to or from the actuator, branches diverged from the respective paths so as to communicate with the motor for swiveling the crushing arms, so that one of these paths will feed the hydraulic fluid to said actuator then the crushing arms are driven to open, wherein one of the branches that is diverged from a hydraulic fluid path for feeding the hydraulic fluid to the actuator when the crushing arms are driven to open has disposed therein an on-off means that normally keeps this branch closed, but will open it so as to drive the motor only when a pressure applied to the on-off means rises above a predetermined level, whereas the other branch has a back-flow inhibitor disposed therein so that any amount of the hydraulic fluid cannot flow back towards the hydraulic motor; and a delay device is incorporated in said one branch such that when a pressure therein or in the main hydraulic path has exceeded a limit and a given period of delay time has lapsed, an amount of hydraulic fluid will be supplied to the swiveling motor after the crushing arms have fully opened.

5. A crushing apparatus as defined in claim 4, wherein the on-off means is composed of a relief valve and a throttle valve.

6. A crushing apparatus as defined in claim 5, wherein the relief valve is adjustable as to its actuation pressure.

7. A crushing apparatus as defined in claim 4, wherein the hydraulic motor is accompanied by an impacting pressure bypassing means.

8. A crushing apparatus as defined in claim 4, wherein two ports are formed in the swiveling motor in order to charge it with the hydraulic fluid and also to discharge the fluid from the motor, and one, two or more bypass lines normally standing closed are formed between the two ports so that when one of the ports shows a pressure above a predetermined value, this port will come into a fluid communication with the other port of a lower pressure.

9. A crushing apparatus as defined in claim 4, wherein two ports are formed in the swiveling motor as an inlet and an outlet for the hydraulic fluid, and each of two bypass lines respectively intervening between the two ports has relief valves that are installed in the respective bypass lines but in opposite directions, with a check valve being disposed beside and in parallel with each relief valve so as to constitute a sub-bypass in each bypass line.

10. A crushing apparatus as defined in claim 4, wherein two ports are formed in the swiveling motor as an inlet and an outlet for the hydraulic fluid, two bypass lines and intervene between these ports, a couple of first check valves disposed in one of the bypass lines being arranged face-to-face, with a couple of second check valves being arranged back-to-back in the other bypass line and a relief valve connects a first intermediate point between the first check valves to a second intermediate point between the second check valves, so that an amount of hydraulic fluid will be permitted to flow from the bypass line to the other one when a pressure at the first intermediate point rises above a limit.

11. An attachment for use in a construction machinery and adapted for connection to a working arm mounted on a self-propelled working platform or truck having a hydraulic-pressure-generating equipment, the attachment comprising:

a swiveling mechanism such that a hydraulic swiveling actuator will rotate the attachment;

a branch diverging from a main hydraulic path connected to another hydraulic actuator so that the swiveling actuator receives hydraulic fluid through the branch;

crushing arms connected to the main hydraulic path and movable between a closed position and a fully open position;

an on-off means for opening said branch so as to drive the swiveling actuator only when a pressure in the main path rises above a predetermined level; and a delay device incorporated in the branch such that when a pressure therein or in the main hydraulic path has exceeded a limit and a given period of delay time has lapsed, an amount of hydraulic fluid will be supplied to the swiveling motor after the crushing arms have fully opened.

12. An attachment as defined in claim 11, wherein the attachment is a crushing apparatus having crushing arms, with the another actuator being an hydraulic cylinder that closes and opens the arms.

13. An attachment as defined in claim 12, wherein the branch diverges from a portion of the main path feeding the hydraulic fluid to open the crushing arms.

14. An attachment as defined in claim 13, wherein the swiveling actuator is a hydraulic motor.

* * * * *